US008458965B1

(12) United States Patent
Rieger

(10) Patent No.: US 8,458,965 B1
(45) Date of Patent: Jun. 11, 2013

(54) WINDOW WELL COVER AND ACCESSORY FOR USE THERE WITH

(76) Inventor: Jerrold F Rieger, Antioch, IL (US)

( * ) Notice: Subject to any disclaimer, the term of this patent is extended or adjusted under 35 U.S.C. 154(b) by 0 days.

(21) Appl. No.: 13/556,416

(22) Filed: Jul. 24, 2012

(51) Int. Cl.

| | |
|---|---|
| ***E02D 29/14*** | (2006.01) |
| ***E04F 17/06*** | (2006.01) |
| ***E06B 3/30*** | (2006.01) |
| ***E06B 5/02*** | (2006.01) |

(52) U.S. Cl.
USPC ..... 52/107; 52/3; 52/19; 52/20; 52/29; 49/50

(58) Field of Classification Search
USPC ..... 49/33, 50, 61–63, 67, 131; 52/3, 52/19, 20, 29, 107, 169.6
See application file for complete search history.

(56) References Cited

U.S. PATENT DOCUMENTS

| | | | | |
|---|---|---|---|---|
| 2,898,638 | A | 8/1959 | Druckhamer | |
| 3,048,897 | A * | 8/1962 | Slade | 52/19 |
| 3,048,900 | A * | 8/1962 | Slade | 52/107 |
| 3,128,508 | A * | 4/1964 | Burnham | 52/107 |
| 3,703,791 | A * | 11/1972 | Slade | 52/107 |
| 3,844,076 | A | 10/1974 | Schock | |
| 3,943,662 | A | 3/1976 | LaRosa | |
| 3,999,334 | A * | 12/1976 | Webb | 52/20 |
| D403,436 | S | 12/1998 | Gregory | |
| 7,444,784 | B2 * | 11/2008 | Brown | 52/107 |
| 8,091,292 | B1 * | 1/2012 | Jalbert | 52/107 |
| 2003/0097802 | A1 | 5/2003 | Kim et al. | |
| 2004/0035063 | A1 | 2/2004 | Bryant et al. | |
| 2008/0034673 | A1 * | 2/2008 | Tran | 52/19 |
| 2011/0203194 | A1 * | 8/2011 | Kelsch et al. | 52/69 |

* cited by examiner

*Primary Examiner* — Robert Canfield
(74) *Attorney, Agent, or Firm* — Kyle Fletcher

(57) ABSTRACT

The window well cover and accessory for use there with includes a cover that is hingedly attached top of a window well. The window well cover includes height-adjusting means to tilt the window well to a particular orientation with respect to the window well. The window well cover includes an accessory that is secured to a top surface of the window well cover, and which provides a decorative feature to an adjacent home as well as a weighting means for maintaining the window well cover atop of the window well. The window well cover is constructed of a transparent material to enable light to penetrate down into the window well. The window well cover is capable of rotating outwardly and away from the respective home in order to provide ingress and egress with respect to the window well.

18 Claims, 6 Drawing Sheets

WINDOW WELL COVER AND ACCESSORY FOR USE THERE WITH

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of window well covers, more specifically, a window well cover that includes an accessory mounted on a top surface, which provides a decorative effect to an adjacent house.

B. Discussion of the Prior Art

As will be discussed immediately below, no prior art discloses a window well cover that includes an accessory that attaches onto a top surface of said window well cover in order to provide a weighted base for said window well cover; wherein the accessory may include a decorative feature within or imprinted thereon said accessory that provides a decorative effect to an adjacent home; wherein the window well cover includes a pair of support brackets that attach to a mounting support via a hinge; wherein the mounting support is secured to rotatably engaged with respect to the window well, and shall rotate away from the side of the home to enable access in or out of the window well as needed; wherein the window well cover is made of a transparent material so as to enable light to pass through and into the window well; wherein the support brackets may include height adjustment means that are located on a side adjacent the side surface of said home; wherein the accessory is constructed of a transparent case that supports an ornamental decoration therein, which is visible from afar and which adds a decorative effect to the adjacent home.

The Bryant et al. Patent Application Publication (U.S. Pub. No. 2004/0035063) discloses a decorative basement window well shield. However, the decorative shield is for use against the wall forming the window wel, and not a clear cover that includes a decorative accessory for use atop of the window well cover.

The Kim et al. Patent Application Publication (U.S. Pub. No. 2003/0097802) discloses a basement window well protective cover. However, the window well protective cover does not include an accessory secured to a top surface, which adds a decorative feature to an adjacent home, and which is rotated outwardly with respect to the home to enable ingress and egress with respect to the window well.

The Rosa Patent (U.S. Pat. No. 3,943,662) discloses a basement window conversion unit comprising a pair of ornamentally decorated siding panels. However, the siding panels do not form a cover for a window well, which includes an accessory secured to a top surface for making a decorative feature against an adjacent home.

The Schock Patent (U.S. Pat. No. 3,844,076) discloses a basement window shield. However, the shield forms the window well, and does, not include a cover that rests atop of the window well.

The Druckhamer Patent (U.S. Pat. No. 2,898,638) discloses a basement window well cover. However, the cover is hingedly attached to the side of the adjacent home, and does not include a decorative accessory that acts as weight and a decorative feature to the adjacent home.

The Gregory Patent (U.S. Pat. No. Des. 403,436) illustrates a design for a basement window well cover.

While the above-described devices fulfill their respective and particular objects and requirements, they do not describe a window well cover that includes an accessory that attaches onto a top surface of said window well cover in order to provide a weighted base for said window well cover; wherein the accessory may include a decorative feature within or imprinted thereon said accessory that provides a decorative effect to an adjacent home; wherein the window well cover includes a pair of support brackets that attach to a mounting support via a hinge; wherein the mounting support is secured to a top, edge of a window well such that the window well cover is rotatably engaged with respect to the window well, and shall rotate away from the side of the home to enable access in or out of the window well as needed; wherein the window well cover is made of a transparent material so as to enable light to pass through and into the window well; wherein the support brackets may include height adjustment means that are located on a side adjacent the side surface of said home; wherein the accessory is constructed of a transparent case that supports an ornamental decoration therein, which is visible from afar and which adds a decorative effect to the adjacent home. In this regard, the tornado shelter departs from the conventional concepts and designs of the prior art.

SUMMARY OF THE INVENTION

The window well cover and accessory for use there with includes a cover that is hingedly attached top of a window well. The window well cover includes height adjusting means to tilt the window well to a particular orientation with respect to the window well. The window well cover includes an accessory that is secured to a top surface of the window well cover, and which provides a decorative feature to an adjacent home as well as a weighting means for maintaining the window well cover atop of the window well. The window well cover is constructed of a transparent material to enable light to penetrate down into the window well. The window well cover is capable of rotating outwardly and away from the respective home in order to provide ingress and egress with respect to the window well.

A further object of the invention is to provide a cover for a window well that rotates outwardly and away from a home to enable egress and ingress with respect to the home.

A further object of the invention is to provide a window well cover that is transparent to enable light to penetrate down into the window well.

A further object of the invention is to provide a window well cover that includes an accessory that is secured to a top surface, which acts as a weight and as a decorative feature to the adjacent home.

Another object of the invention is to provide an accessory that includes decorative indicia positioned inside of or imprinted therein so as to produce a decorative effect when viewed away from said adjacent home.

A further object of the invention is to include a window well cover that includes height-adjusting means that vary the orientation of the window well cover with respect to a top edge of the window well.

These together with additional objects, features and advantages of the window well cover and accessory for use there with will be readily apparent to those of ordinary skill in the art upon reading the following detailed description of presently preferred, but nonetheless illustrative, embodiments of the window well cover and accessory for use there with when taken in conjunction with the accompanying drawings.

In this respect, before explaining the current embodiments of the window well cover and accessory for use there with in detail, it is to be understood that the window well cover and accessory for use there with is not limited in its applications to the details of construction and, arrangements of the components set forth in the following description or illustration. Those skilled in the art will appreciate that the concept of this disclosure may be readily utilized as a basis for the design of other structures, methods, and systems for carrying out the several purposes of the window well cover and accessory for use there with.

It is therefore important that the claims be regarded as including such equivalent construction insofar as they do not depart from the spirit and scope of the window well cover and accessory for use there with. It is also to understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
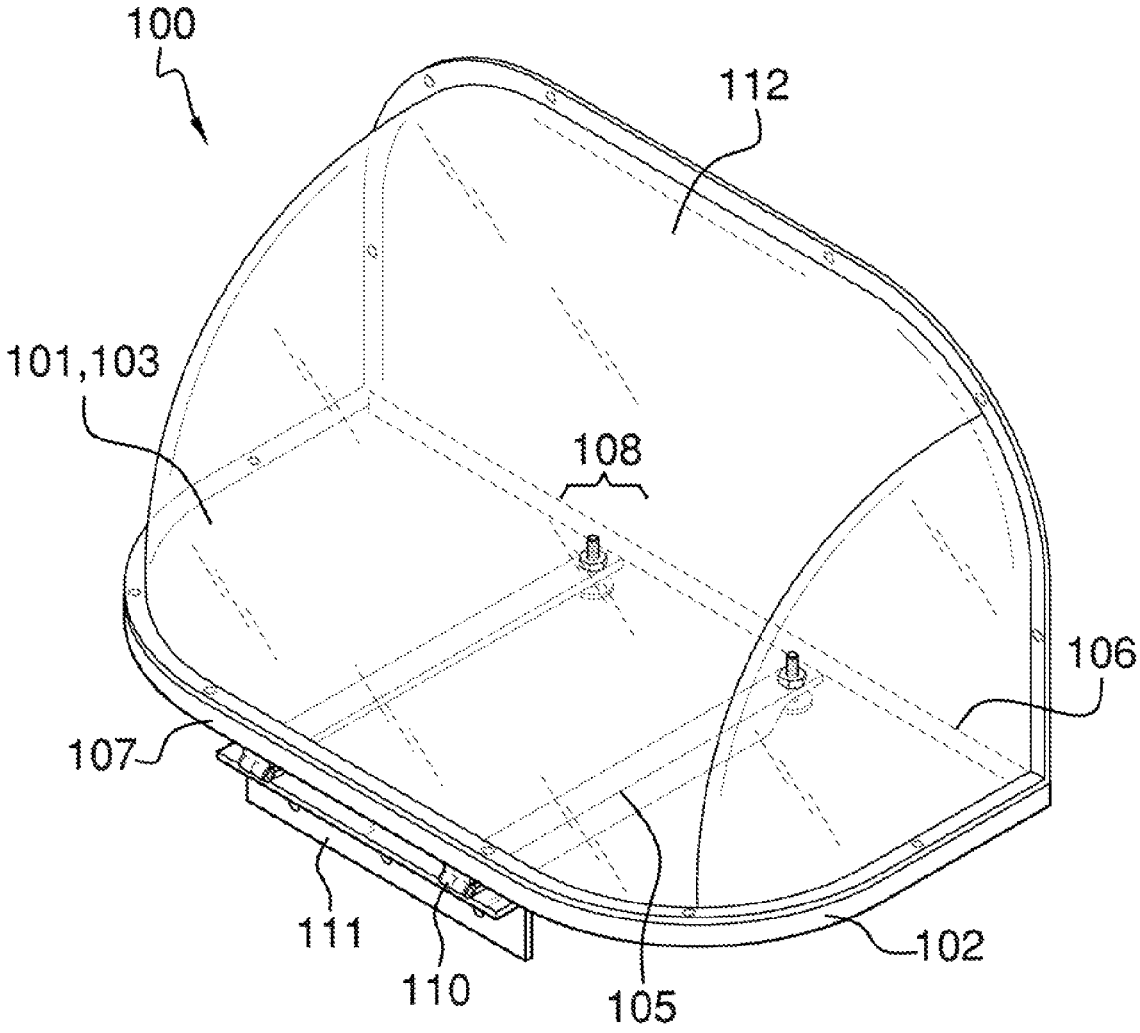
FIG. 1 illustrates a perspective view of the window well cover and accessory by itself with detail of the support brackets traversing across the window well cover in order to illustrate the transparent material used for the window well cover.
Figure 2:
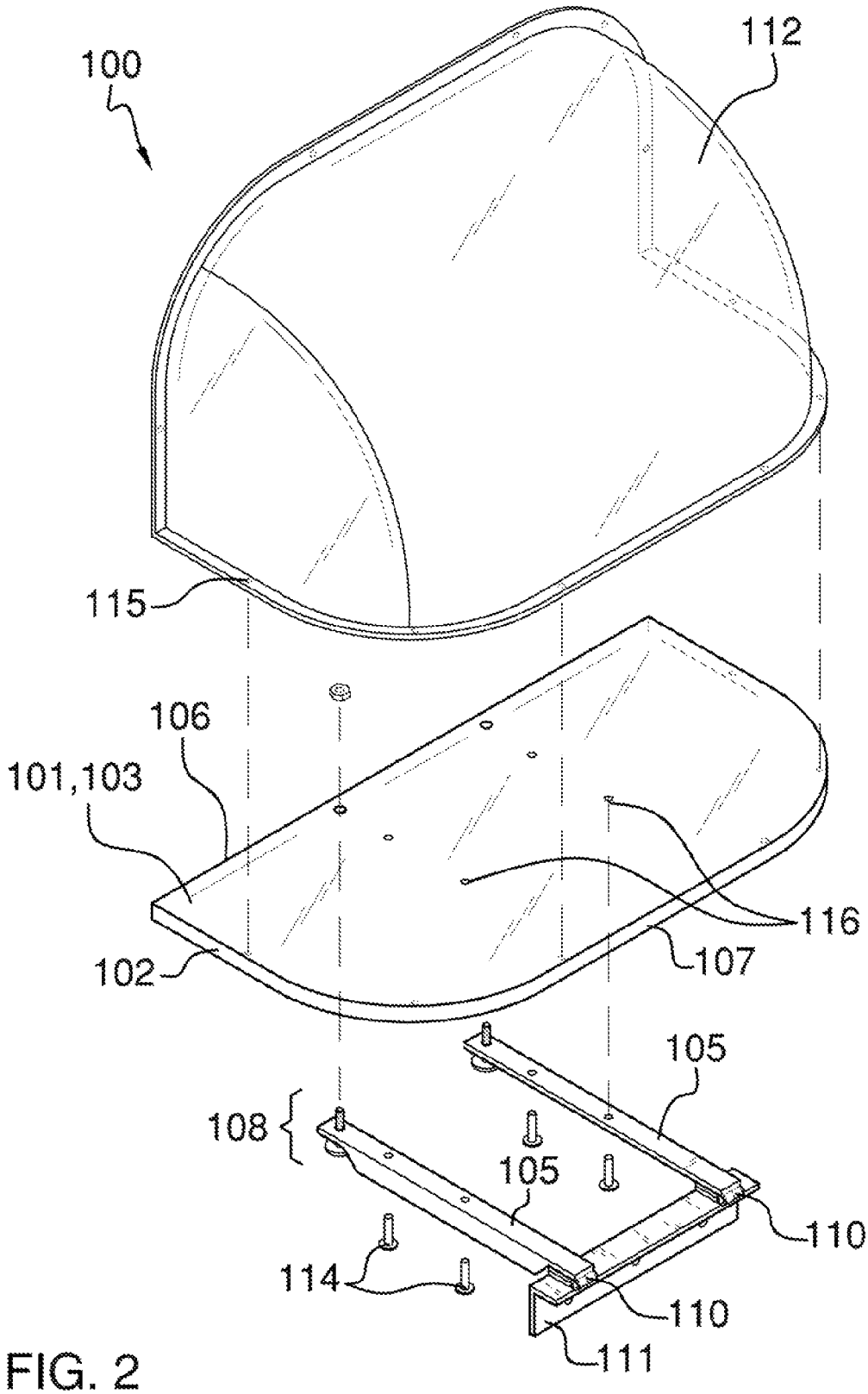
FIG. 2 illustrates an exploded view of the window well cover and accessory wherein the support brackets and mounting support are aligned under the window well cover, which is aligned under the accessory.
Figure 3:
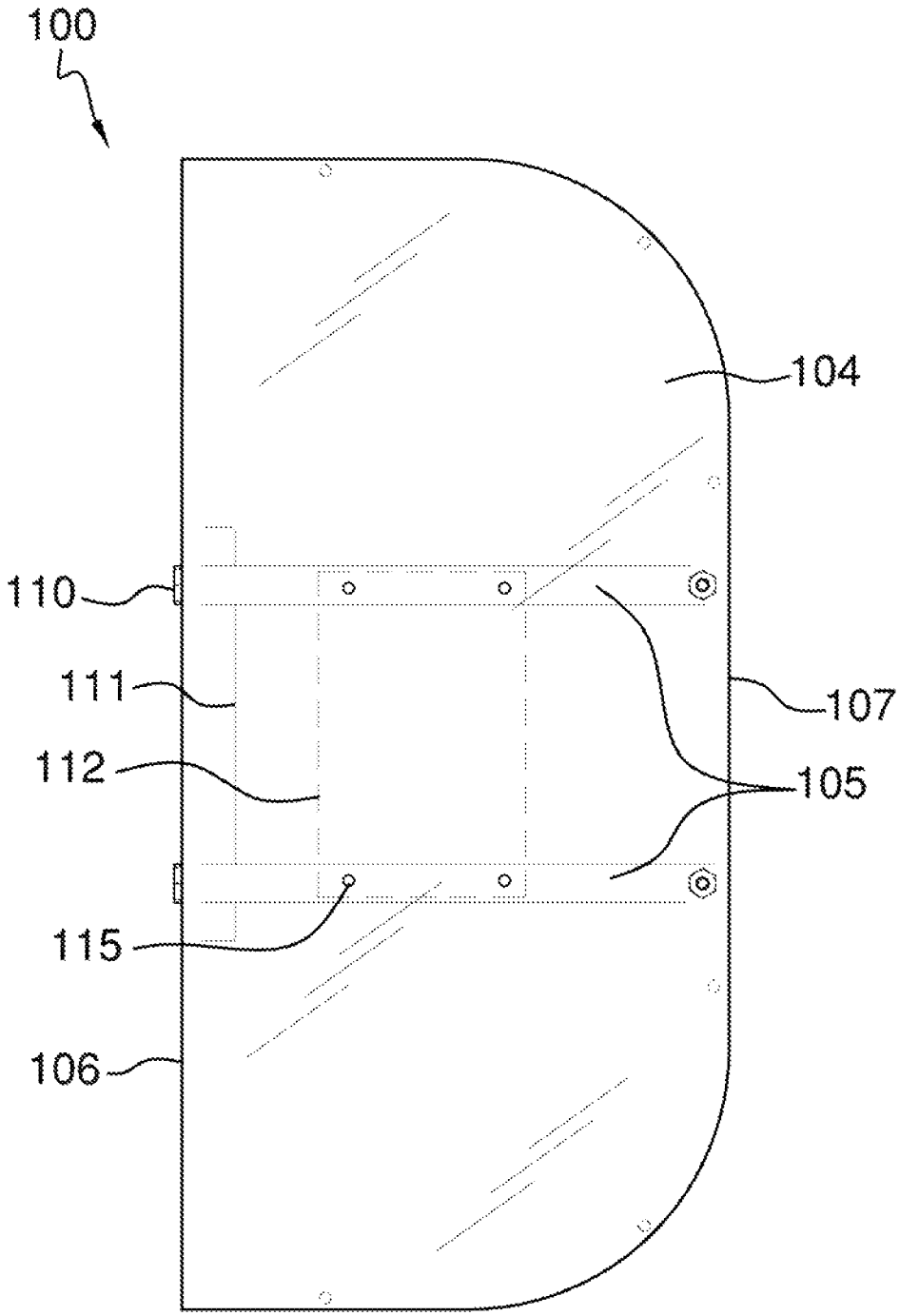
FIG. 3 illustrates a bottom view of the window well cover and accessory by itself.
Figure 4:
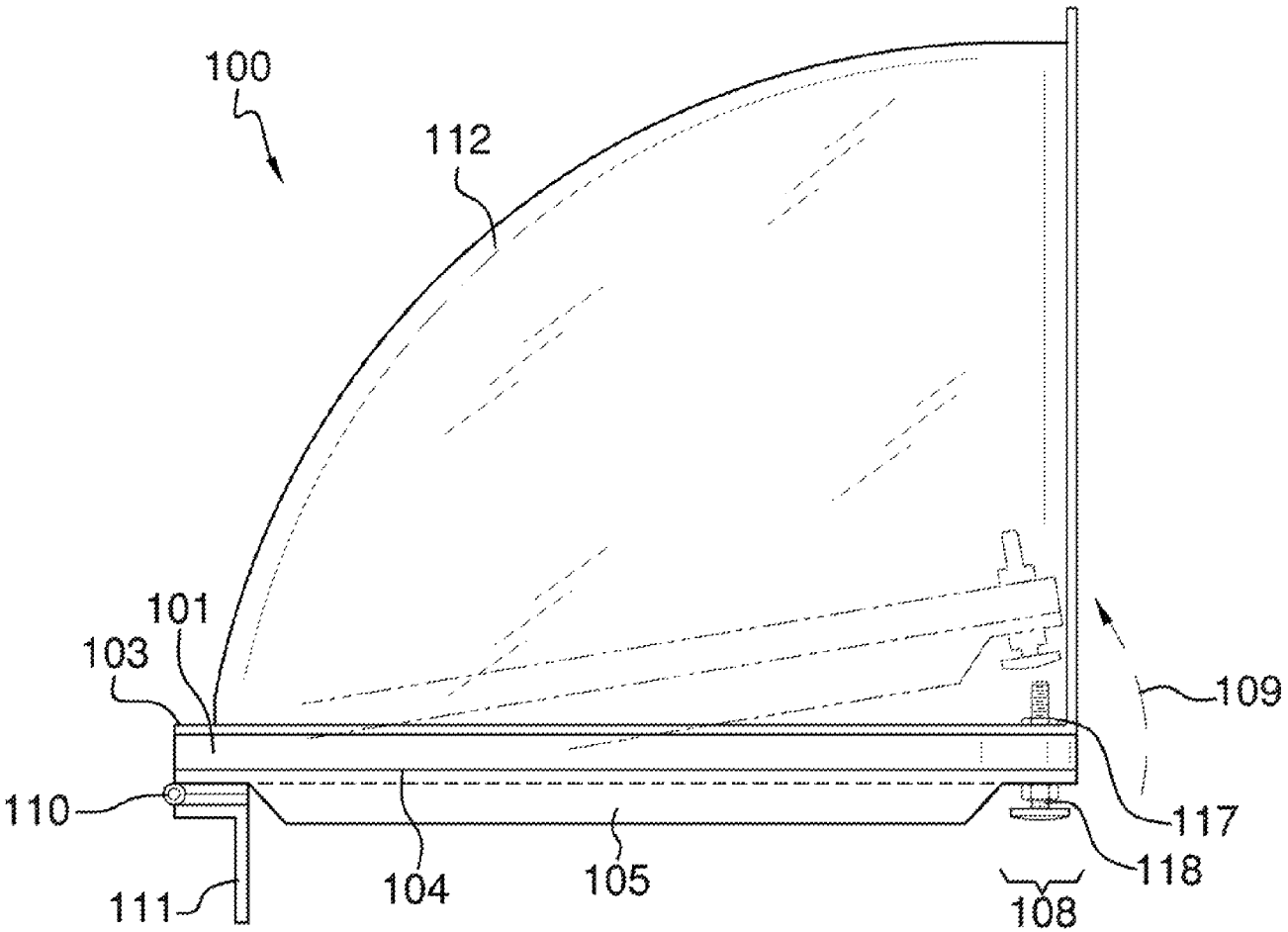
FIG. 4 illustrates a side view of the window well cover and accessory in which the window well cover is rotating with respect to the mounting support via the hinge.
Figure 5:
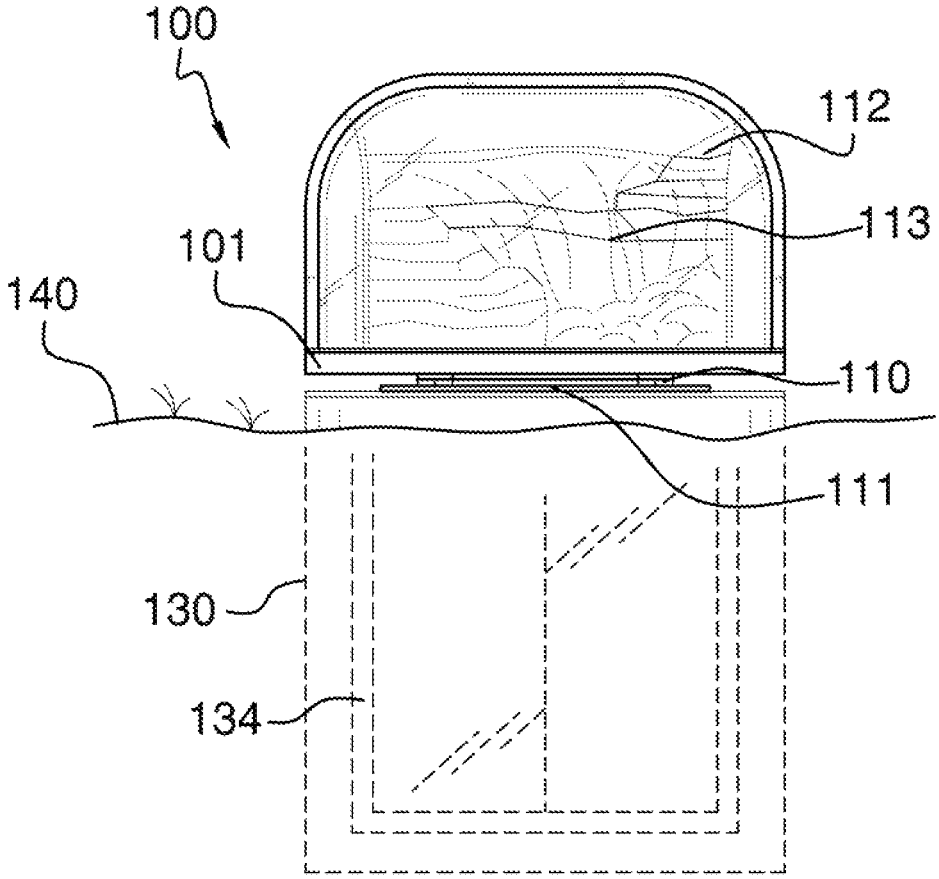
FIG. 5 illustrates a front view of the window well cover and accessory in use with a window well wherein the window is below the ground surface, and further detailing the decorative feature of the accessory, which is secured to a top surface of the window well cover.
Figure 6:
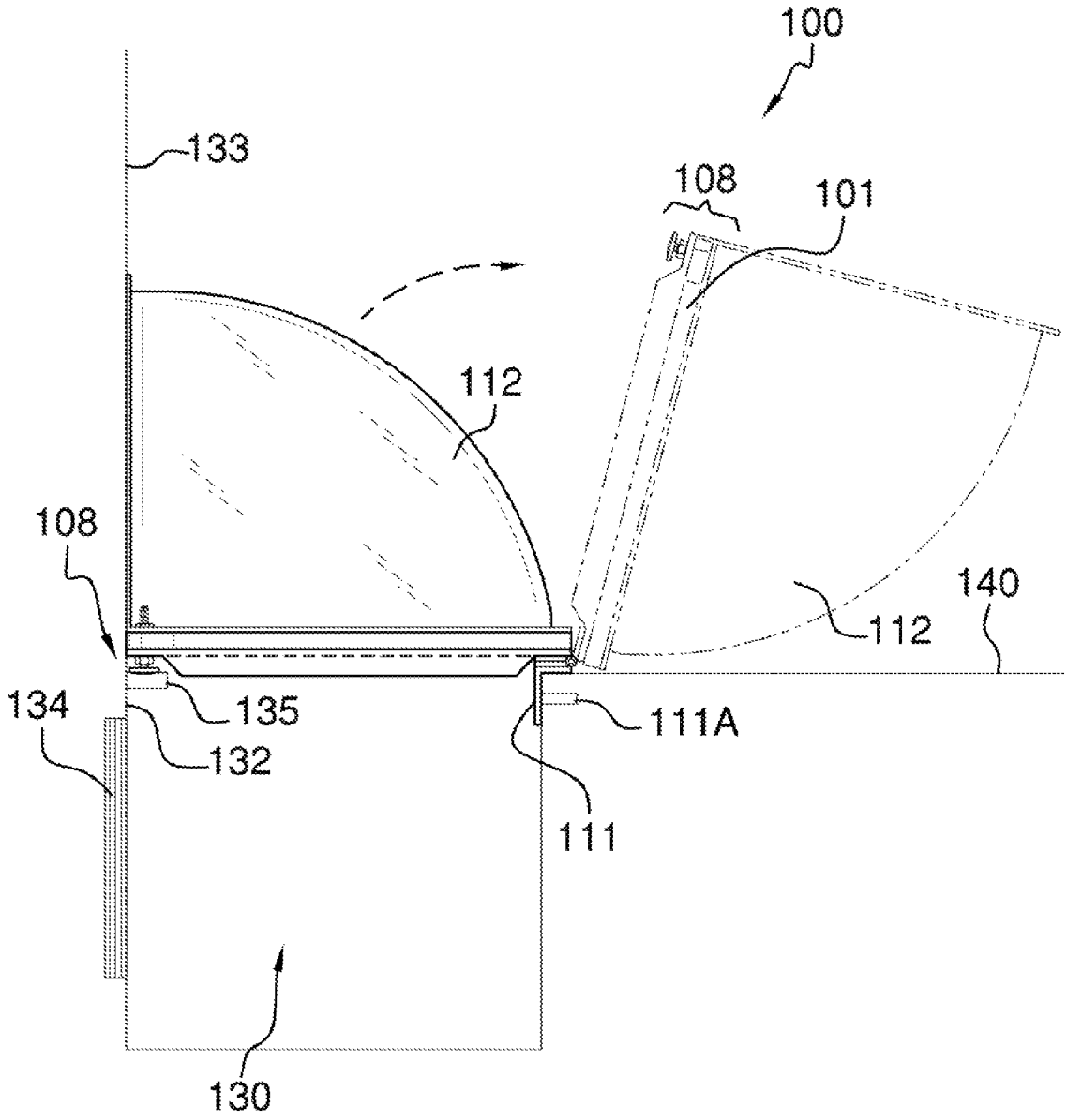
FIG. 6 illustrates a side view of the window well cover and accessory installed on the window well with rotational movement of the window well cover and accessory from a rested position to an open position whereby the window well is exposed.

Detailed reference will now be made to the preferred embodiment of the present invention, examples of which are illustrated in FIGS. 1-6. A window well cover and accessory for use there with 100 (hereinafter invention) includes a window well cover 101 of no particular size and shape, and which is constructed of a transparent material such as a plastic so as to enable light to pass through the window well cover and illuminate a window well 130 located there under. The window well cover 101 is further defined by a perimeter 102 that rests atop the window well 130. The window well cover 101 is further defined by a top surface 103 and a bottom surface 104.

It shall be noted that the window well 130 extends from a side surface 132 of an adjacent home 133 and provides an open space directly adjacent a window 134 of the adjacent home 133.

The invention 100 includes a pair of support brackets 105 that attach to the bottom surface 104 of the window well cover 101. Moreover, the support brackets 105 extend from a home edge 106 of the window well cover 101 to a well edge 107 that is opposite of the home edge 106. The support brackets 105 include height-adjusting means 108 at the home edge 106, and adjust a tilt angle 109 of the window well cover 101 with respect to the well edge 107 and/or ground surface 140.

The support brackets 105 extend and are secured to a hinge 110, which is secured to a mounting support 111. The mounting support 111 is perpendicularly engaged with respect to the support brackets 105. The mounting support 111 is secured to the well edge 107 via bolts/screw/nails/rivets/etc 111A such that the window well cover 101 is able, to rotate with respect to the window well 130. Moreover, the window well cover 101 is able to rotate upwardly and away from the adjacent home 133 in order to enable egress and ingress to the window well 130 with respect to the surrounding ground surface 140.

The invention 100 includes a decorative accessory 112 that attaches to the top surface 103 of the window well cover 101, and which may include a decoration 113 imprinted therein or simply located inside of the decorative accessory. Moreover, the decorative accessory 112 and the decoration 113 contained therein provides a decorative effect to the adjacent home 133 when looking at the adjacent home 133 from afar. Moreover, the decorative accessory 112 is constructed of a hollowed and transparent material such that the decoration 113 is highly visible from outside of the decorative accessory 112. It shall be noted that the decorative accessory 112, as depicted, resembles a curved top. The decorative accessory 112 may have any number of varying shapes. It should also be noted that the decoration 113, as depicted, resembles an oriental garden accessory. The type of decoration 113 included in the decorative accessory 112 can vary according to the preference of the end user. The decorative accessory 112 has two primary functions: (1) provide a decorative effect to the adjacent home 133, and (2) act as weight to keep the window well cover 101 from opening during a gust of wind from above.

It shall be noted that the decorative accessory 112 does not limit the ability of the window well cover 101 to rotate from a flat position to an egress position whereby an end user is able to exit the home 113 through the window well 130.

The decorative accessory 112 and the support brackets 105 attach to the window well cover 101 on opposing surfaces via bolts 114 extending across. The decorative accessory 112 may include threaded holes 115 with which to engage the bolts 114, which traverse bolt holes 116 provided in the window well cover 101.

The height adjusting means 108 includes a nut 117 and foot-bolt member 118, which secure the window well cover 101 to the support brackets 105. Moreover, the foot-bolt member 118 can be rotated to adjust up/down the foot-bolt member 118 with respect to the bottom surface 104 of the window well cover 101, which thus adjusts the tilt angle 109. Moreover, the foot-bolt member 118 shall rest atop an inner well edge 135.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships, to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A window well cover and accessory for use there with comprising:

a window well cover that attaches to a window well, and which opens upwardly and away from an adjacent home to enable ingress and egress to said window well;

wherein said window well cover includes support brackets that are secured to the window well, and which extend to and attach to a hinge and mounting support located on a well edge opposite of a home edge along a perimeter of said window well;

wherein a decorative accessory is secured to a top surface of the window well cover and includes a decoration, which produces a decorative effect to the adjacent home from afar.

2. The window well cover as described in claim 1 wherein the window well cover is further defined with a bottom surface from which the support brackets are secured against via bolts that attach to both the support brackets and the decorative accessory positioned on the top surface of the window well cover.

3. The window well cover as described in claim 2 wherein the window well cover is made of a transparent material so as to enable light to enter into the window well located there under.

4. The window well cover as described in claim 3 wherein the window well cover is further defined by a perimeter, which rests atop of the window well.

5. The window well cover as described in claim 4 wherein the support brackets extend from the home edge to the wall edge; wherein the support brackets include height-adjusting means that enable adjustment of a tilt angle formed between the window well cover and the well edge and/or ground surface.

6. The window well cover as described in claim 5 wherein the height adjusting means each include a nut and foot-bolt member, which secure the window well cover to the support brackets; wherein the foot-bolt member is rotated up/down to adjust the tilt angle; wherein the foot-bolt member shall rest atop an inner well edge.

7. The window well cover as described in claim 5 wherein the mounting support is perpendicularly engaged with respect to the support brackets; wherein the mounting support is secured to the well edge such that the window well cover is able to rotate with respect to the window well.

8. A window well cover and accessory for use there with comprising:

a window well cover that attaches to a window well, and which opens upwardly and away from an adjacent home to enable ingress and egress to said window well;

wherein said window well cover includes support brackets that are secured to the window well, and which extend to and attach to a hinge and mounting support located on a well edge opposite of a home edge along a perimeter of said window well;

wherein a decorative accessory is secured to a top surface of the window well cover and includes a decoration, which produces a decorative effect to the adjacent home from afar;

wherein the decorative accessory includes a decoration within; wherein the decorative accessory is transparent and of hollowed construction so as to enable visualization of the decoration contained therein.

9. The window well cover as described in claim 8 wherein the window well cover is made of a transparent material so as to enable light to enter into the window well located there under.

10. The window well cover as described in claim 9 wherein the window well cover is further defined by a perimeter, which rests atop of the window well.

11. The window well cover as described in claim 10 wherein the support brackets extend from the home edge to the wall edge; wherein the support brackets include height-adjusting means that enable adjustment of a tilt angle formed between the window well cover and the well edge and/or ground surface.

12. The window well cover as described it claim 11 wherein the height adjusting means each include a nut and foot-bolt member, which secure the window well cover to the support brackets; wherein the foot-bolt member is rotated up/down to adjust the tilt angle; wherein the foot-bolt member shall rest atop an inner well edge.

13. The window well cover as described in claim 12 wherein the mounting support is perpendicularly engaged with respect to the support brackets; wherein the mounting support is secured to the well edge such that the window well cover is able to rotate with respect to the window well.

14. A window well cover and accessory for use there with comprising:

a window well cover that attaches to a window well, and which opens upwardly and away from an adjacent home to enable ingress and egress to said window well;

wherein said window well cover includes support brackets that are secured to the window well, and which extend to and attach to a hinge and mounting support located on a well edge opposite of a home edge along a perimeter of said window well;

wherein a decorative accessory is secured to a top surface of the window well cover and includes a decoration, which produces a decorative effect to the adjacent home from afar;

wherein the decorative accessory includes a decoration within; wherein the decorative accessory is transparent and of hollowed construction so as to enable visualization of the decoration contained therein;

wherein the window well cover is further defined with a bottom surface from which the support brackets are secured against via bolts that attach to both the support brackets and the decorative accessory positioned on the top surface of the window well cover.

15. The window well cover as described in claim 14 wherein the window well cover is made of a transparent material so as to enable light to enter into the window well located there under.

16. The window well cover as described in claim 15 wherein the window well cover is further defined by a perimeter, which rests atop of the window well; wherein the support brackets extend from the home edge to the wall edge; wherein the support brackets include height-adjusting means that enable adjustment of a tilt angle formed between the window well cover and the well edge and/or ground surface.

17. The window well cover as described in claim 16 wherein the height adjusting means each include a nut and foot-bolt member, which secure the window well cover to the support brackets; wherein the foot-bolt member is rotated up/down to adjust the tilt angle; wherein the foot-bolt member shall rest atop an inner well edge.

18. The window well cover as described in claim 17 wherein the mounting support is perpendicularly engaged with respect to the support brackets; wherein the mounting support is secured to the well edge such that the window well cover is able to rotate with respect to the window well.

* * * * *